US005082389A

United States Patent [19]

Balemi

[11] Patent Number: 5,082,389

[45] Date of Patent: Jan. 21, 1992

[54] CONNECTOR WITH A SPRING-BIASED CLOSURE MEMBER

[76] Inventor: William J. Balemi, 15 Sunderland Road, Bucklands Beach, Auckland, New Zealand

[21] Appl. No.: 165,171

[22] Filed: Mar. 7, 1988

[30] Foreign Application Priority Data

Jun. 4, 1987 [NZ] New Zealand ..... 220557
Dec. 10, 1987 [NZ] New Zealand ..... 222864

[51] Int. Cl.[5] ..... E04F 3/28

[52] U.S. Cl. ..... 403/322; 403/325; 414/723; 37/117.5

[58] Field of Search ..... 414/723, 724; 403/322, 403/325, 319, 315, 316; 172/272, 274, 275; 37/117.5

[56] References Cited

U.S. PATENT DOCUMENTS

| | | | |
|---|---|---|---|
| 3,964,622 | 6/1976 | Blair et al. | 414/723 |
| 3,985,249 | 10/1976 | Aker et al. | 172/275 X |
| 4,203,238 | 5/1980 | Banger et al. | 172/272 X |
| 4,214,840 | 7/1980 | Beales | 414/723 X |
| 4,311,428 | 1/1982 | Arnold | 414/723 |
| 4,355,945 | 10/1982 | Pilch | 414/723 X |
| 4,436,477 | 3/1984 | Lenertz et al. | 37/117.5 X |
| 4,480,955 | 11/1984 | Andrews et al. | 414/723 |
| 4,632,595 | 12/1986 | Schaeff | 403/322 X |
| 4,650,388 | 3/1987 | Frioux et al. | 403/322 X |
| 4,810,162 | 3/1989 | Foster | 172/272 X |
| 4,871,292 | 10/1989 | Milanowski | 403/316 X |

FOREIGN PATENT DOCUMENTS 1860283 3/1984 Australia .

*Primary Examiner*—Peter M. Cuomo
*Attorney, Agent, or Firm*—Fleit, Jacobson, Cohn, Price, Holman & Stern

[57] ABSTRACT

A connector for connecting implements on tools such as digging devices to a boom or the like comprises a body (1, 3) having first connection elements (8, 9) enabling the body to be mounted on a carrying device, second connection elements for engaging an implement with the (1,3) in the form of spaced apart first and second recesses (12, 11) on the body. The respective connection elements are mutually oriented for mounting the connector on the carrying device with the first recess (12) opening substantially downwardly and the second recess (11) opening in a direction substantially at right angles to the direction of opening of the first recess (12). At least the first recess (12) having an entrance and being substantially closeable by a closure member (13). A fluid pressure operated piston (34, 21) and cylinder (30, 22) assembly moves the closure member (13) toward or away from a position wherein the closure member substantially covers the entrance to the first recess. A spring device (31, 16) moves the closure member (13) toward or away from a position wherein the first recess (12) is substantially open.

17 Claims, 2 Drawing Sheets

CONNECTOR WITH A SPRING-BIASED CLOSURE MEMBER

FIELD OF THE INVENTION

This invention relates to a connector and has been devised particularly though not necessarily for use as a connector to enable implements or tools such as digging attachments to be connected to a boom or the like mounted on a vehicle.

BRIEF SUMMARY OF THE INVENTION

It is an object of the present invention to provide a connector which will at least provide the public with a useful choice.

Accordingly the invention consists in a connector comprising a body, first connection means enabling said body to be mounted on a carrying device, second connection means to enable an implement to be engaged with said body, said second connection means comprising spaced apart first and second recesses, at least said first recess being closeable by a closure member, a piston and cylinder assembly to move said closure member towards or away from a position wherein said closure member substantially covers the entrance to said first recess, and means to move said closure member towards or away from to a position wherein said first recess is not substantially closed by said closure member.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWING

One preferred form of the invention will now be described with reference to the accompanying drawings wherein.

DETAILED DESCRIPTION

Figure 1:
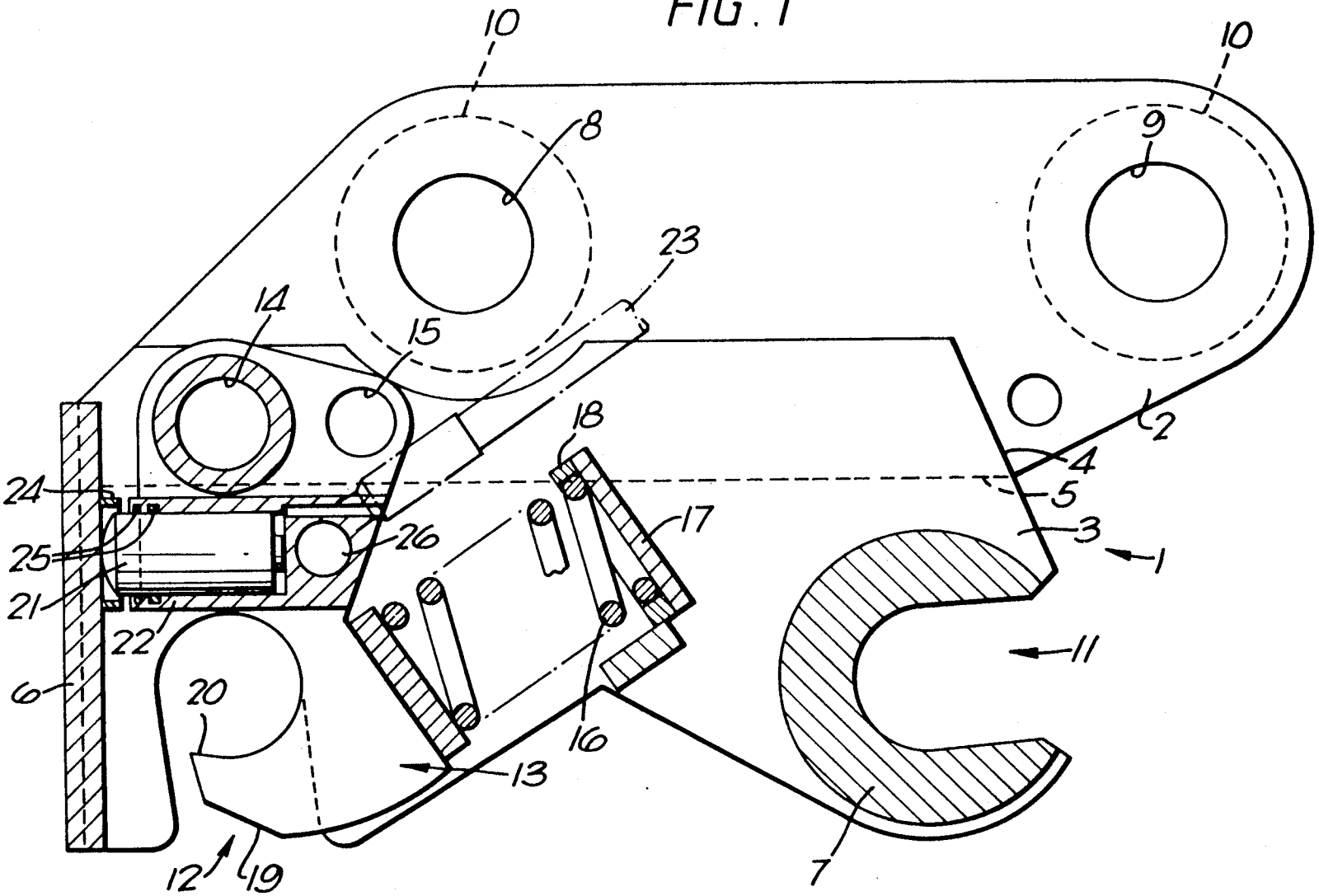
FIG. 1 is a cross-sectional view of a connector according to one preferred form of the invention.

In the form of the invention shown in FIG. 1 a connector is provided which has a body 1 which may be formed by a pair of side plates interconnected by end plates.

In the construction shown each side plate is formed by an upper plate 2 and a lower plate 3 which plates 2 and 3 may be engaged one with the other for example by welding. The plates 2 and 3 are shown in FIG. 1 with part 4 of plate 2 overlapping part 5 of plate 3.

The pairs of plates 2 and 3 may be interconnected at one end by a transverse plate 6 and at the other end by a further transverse plate 7 which in the embodiment shown in the figures is substantially "C" shaped in cross section for reasons that will be described further hereinafter.

The body 1 carries first connection means enabling the connector to be engaged, for example, with a boom (not shown) mounted on a vehicle. The first connection means may take the form of a pair of spaced apart apertures 8 and 9, the apertures 8 and 9 being provided in each plate 2 for example. Thus the connector 1 may be mounted on the boom or the like by pins (not shown) passing through the apertures 8 and 9 and aligned apertures on the boom or otherwise as desired. A reinforcing and/or spacing annular member 10 may be provided about each aperture 8 and 9 if desired or required.

The construction also includes second connection means and these may be formed by a pair of recesses for example in the plate 3. Thus for example an outwardly facing recess 11 may be provided which is continued between the plates by the "C" shaped end plate 7. A downwardly directed recess 12 is also provided. The orientation of these recesses may of course differ if desired.

At least one of the recesses and preferably the recess 12 is associated with a closure member which is able to at least partly close the entrance to the recess 12. Thus in the embodiment of FIG. 1 the closure member may comprise for example a hook member 13 which is pivotally mounted between the side plates for example on a pivot pin 14.

Alignable apertures 15 in hook member 13 and the side plates allow a lock pin (not shown) to be placed through the apertures to hold the hook member 13 or closure member in its substantially closed position.

The hook member 13 is urged towards its substantially closed position for example by a biasing device such as a compression spring 16 one end of which bears against the hook member 13 and the other end of which bears against the body 1, for example a plate 17 positioned between the side plates. The plate 17 may have upper and lower members, or a rim member, 18 so as to provide a socket for the compression spring 16.

The outward leading edge 19 of the hook member 13 may be chamfered or tapered as can be seen in FIG. 1 to allow a member (not shown) which is to be held therein to be snapped thereinto by overcoming the pressure of the spring 16. The inner surface 20 of the hook member is shaped such that the bar or the like positioned therein when the hook member 13 is closed cannot easily push the hook member 13 aside even when there is no pin in the apertures 15. A suitable shape is shown in FIG. 1.

In order to allow the hook member 13 to be forced aside when required a piston 21 and cylinder 22 assembly is provided, for example, a hydraulic piston and cylinder assembly fed through hoseline 23 the controls for which may, for example, be positioned in the cab or otherwise of the vehicle from which the boom extends. Of course a suitable pump (not shown) is provided. The distal end of the piston 21 may bear against the plate 6 for example into a recess or socket formed by walls 24. Suitable seals such as seals 25 are provided in the cylinder 22 or piston 21 wall. The cylinder 22 may be pivotally mounted to the hook member 13 for example at a pivot 26.

Thus as the piston 21 is extended it will bear against the plate 6 forcing the hook member 13 to move, in FIG. 1 counter clockwise, so that the recess 12 is in effect opened. When pressure on the piston 21 is removed the spring 16 will return the hook member 13 to a position wherein the hook member 13 at least partially closes the recess 12.

The use of the invention in the embodiment of FIG. 1 is as follows.

In use where it is desired to attach an implement to a boom the connector 1 is mounted on the boom and the boom moved so that a bar (not shown) on the implement enters the recess 11. The recess 12 may then be forced over another bar (not shown) by pressure of the bar on face 19 or the piston 21 can be extended to open the recess 12 to allow the bar (not shown) to enter. When pressure is released from the piston 21 the compression spring 16 will urge the hook member 13 back to the position shown in FIG. 1. A pin may be placed in the aligned apertures 15 at that time if desired or necessary.

The implement is then used as desired.

When it is desired to remove the implement the pin through aperture 15 if in place is removed and the piston 21 again extended thereby opening the recess 12 so that the connector can be removed from the implement by removing the bars from recesses 12 and 11.

Figure 2:
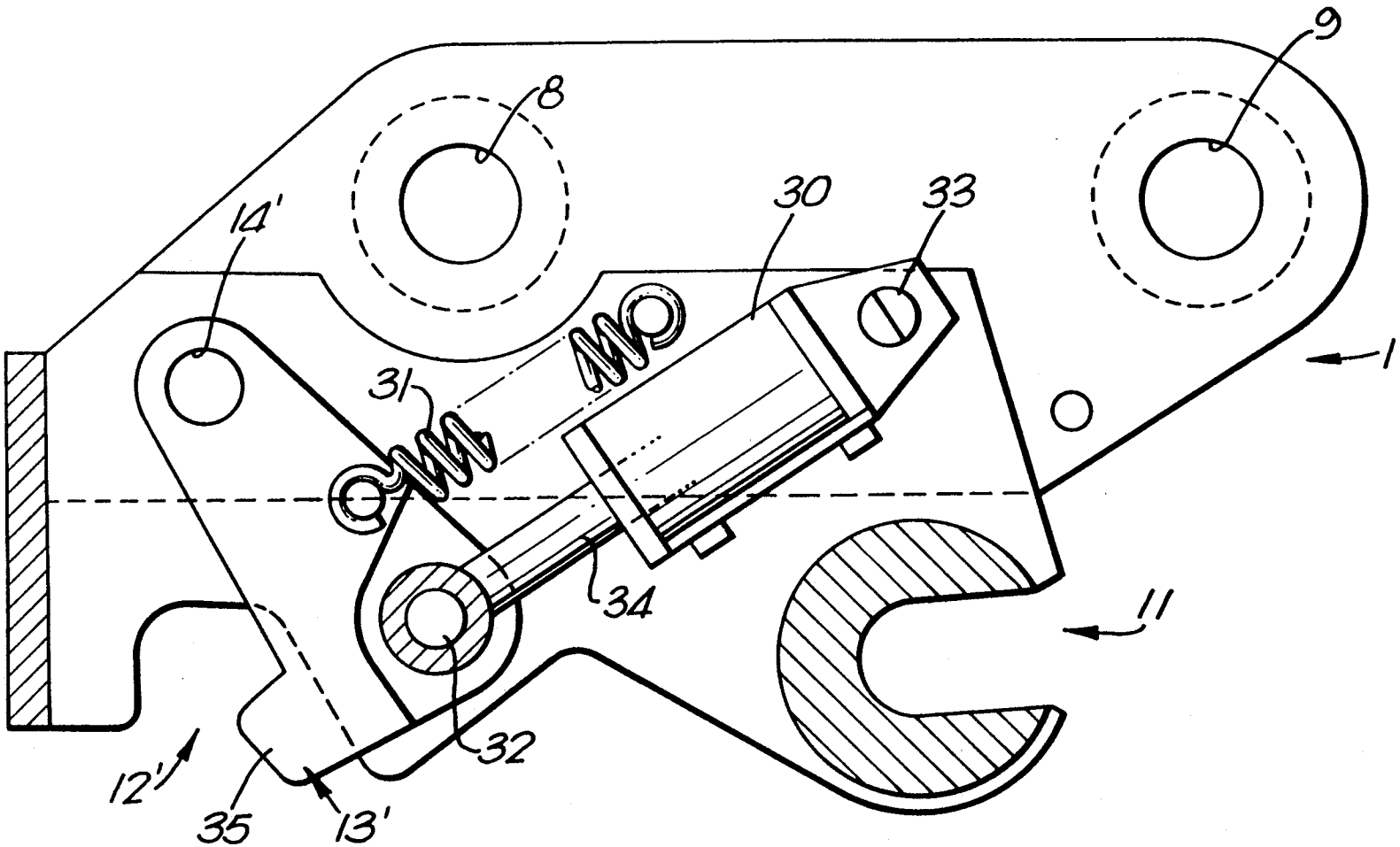
FIG. 2 is a cross-sectional view of a connector according to an alternative form of the invention.

In the embodiment of the invention shown in FIG. 2 the construction is similar save that a piston and cylinder assembly 30 bears on hook member 13' to move the hook member 13' at least partly across the recess 12'. When fluid pressure is removed tension spring 31 operates to withdraw the hook member 13' to open recess 12'. Piston and cylinder assembly 30 is pivotally mounted on the hook member 13' at 32 and to the body 1 at 33. In use, with hook member 13' initially withdrawn, bars (not shown) are positioned in recesses 11 and 12', then the piston 34 of piston and cylinder assembly 30 is extended so that the foot 35 of the hook member 13' closes recess 12' sufficiently to prevent removal of the bar then positioned in recess 12'.

To remove the bar from recess 12' pressure is released from the piston 34 and spring 31 withdraws the hook member 13' allowing the bar to fall or be removed from recess 12.

Thus it can be seen that at least in the preferred forms of the invention a connector is provided which will enable an implement to be connected to the connector in a simple yet effective manner and in which control of the operation can be achieved from for example the cab of a vehicle or another selected position. This is of course advantageous.

what is claimed is:

1. A connector comprising a body, first connection means enabling said body to be mounted on a carrying device, second connection means to enable an implement to be engaged with said body, said second connection means comprising spaced apart first and second recesses on said body, the respective connection means being mutually oriented for mounting the connector on the carrying device with said first recess being substantially downwardly opening and said second recess opening in a direction substantially at right angles to the direction of opening of said first recess, at least said first recess having an entrance and being substantially closeable by a closure member so that a part of the implement enters said first recess prior to closure of said first recess by said closure member, a fluid pressure operated piston and cylinder assembly for moving said closure member towards a closing position wherein said closure member substantially covers the entrance to said first recess when fluid pressure is applied to said piston and cylinder assembly for retaining said part of said implement in said recess, and biasing means for moving said closure member towards an open position wherein said first recess is substantially open when fluid pressure is released from said piston and cylinder assembly for removal of said part of said implement from said first recess thereafter.

2. A connector as claimed in claim 1 wherein said biasing means comprises a tension spring between said closure member and said body.

3. A connector as claimed in claim 1 wherein said closure member is substantially hooked shaped and pivotally mounted to said body.

4. A connector as claimed in claim 3 wherein said first connection means comprises apertures in said body.

5. A connector as claimed in claim 3 wherein said piston and cylinder assembly is pivotally connected to said body and to said closure member.

6. A connector as claimed in claim 3 wherein said biasing means comprises a tension spring between said closure member and said body.

7. A connector as claimed in claim 6 wherein said piston and cylinder assembly is pivotally connected to said body and to said closure member.

8. A connector as claimed in claim 7 wherein the cylinder of said piston and cylinder assembly is pivotally connected to said body, a piston rod extends from said cylinder, and said piston rod is pivotally connected to said closure member.

9. A connector as claimed in claim 8 wherein said body comprises a pair of spaced apart side plates and said closure member, piston and cylinder assembly and means to move said closure member are positioned between said side plates.

10. A connector as claimed in claim 9 wherein said side plates are interconnected by end plates.

11. A connector as claimed in claim 8 wherein:

said closure member comprises a substantially L-shaped member having a first leg extending substantially upwardly and a second leg extending substantially outwardly from said first leg in the direction of said entrance of said first recess so that in said closing position said second leg substantially closes said entrance and in said open position said second leg is retracted from said entrance.

12. A connector as claimed in claim 9 wherein:

said closure member comprises a substantially L-shaped member having a first leg extending substantially upwardly and a second leg extending substantially outwardly from said first leg in the direction of said entrance of said first recess so that in said closing position said second leg substantially closes said entrance and in said open position said second leg is retracted from said entrance.

13. A connector as claimed in claim 1 wherein said body comprises a pair of spaced apart side plates and said closure member, piston and cylinder assembly and means to move said closure member are positioned between said plates.

14. A connector as claimed in claim 13 wherein side plates are interconnected by end plates.

15. A connector as claimed in claim 1 wherein said piston and cylinder assembly is pivotally connected to said body and to said closure member.

16. A connector as claimed in claim 15 wherein the cylinder of said piston and cylinder assembly is pivotally connected to said body, a piston rod extends from said cylinder, and said piston rod is pivotally connected to said closure member.

17. A connector as claimed in claim 1 wherein:

said closure member comprises a substantially L-shaped member having a first leg extending substantially upwardly and a second leg extending substantially outwardly from said first leg in the direction of said entrance of said first recess so that in said closing position said second leg substantially closes said entrance and in said open position said second leg is retracted from said entrance.

* * * * *